United States Patent [19]

Wurtz

[11] 4,357,757

[45] Nov. 9, 1982

[54] PERSPECTIVE DRAWING MACHINE

[76] Inventor: Frank R. Wurtz, 4570 Apricot Rd., Simi Valley, Calif. 93063

[21] Appl. No.: 151,645

[22] Filed: May 20, 1980

[51] Int. Cl.[3] ..... B43I 13/14

[52] U.S. Cl. ..... 33/434

[58] Field of Search ..... 33/432, 433, 434, 445

[56] References Cited

U.S. PATENT DOCUMENTS 3,714,714 2/1973 Bullard ..... 33/445

FOREIGN PATENT DOCUMENTS 78072 2/1949 Czechoslovakia ..... 33/432

272068 3/1914 Fed. Rep. of Germany ..... 33/432

*Primary Examiner*—Harry N. Haroian

[57] ABSTRACT

This invention relates to a perspective drawing machine and more particularly, to a machine which will keep track of a chosen vanishing point. This invention describes a mechanical machine in which the corrected voltage is computed on an external calculator or computer, which when found on the output potentiometer will result in the correct line pointing at the invisable vanishing point.

10 Claims, 12 Drawing Figures

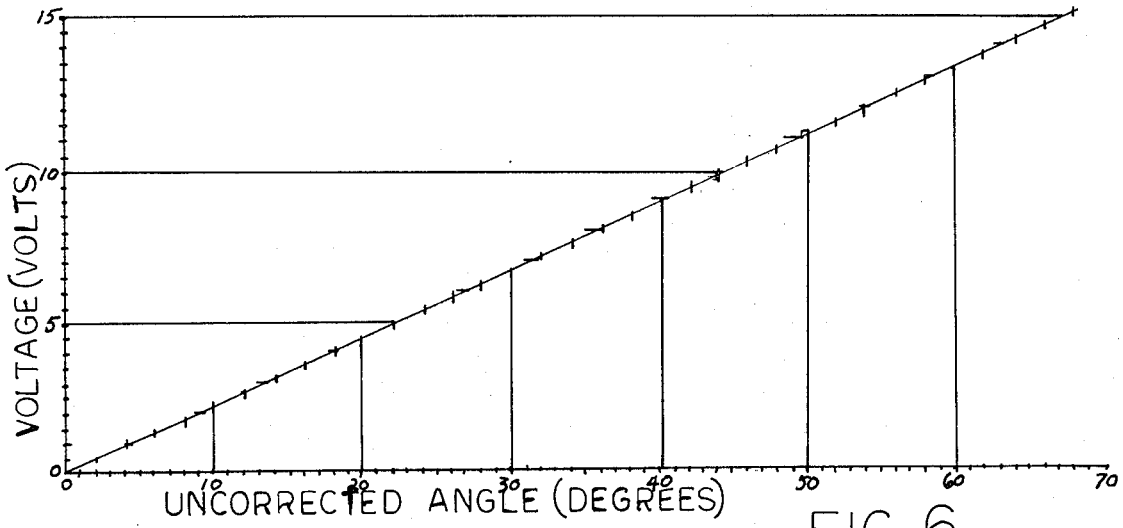
FIG. 6
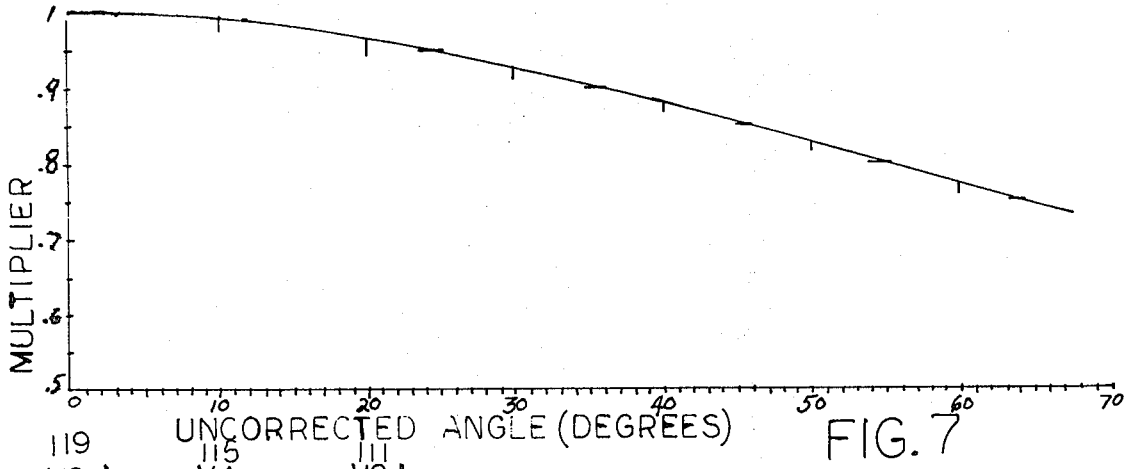
FIG. 7
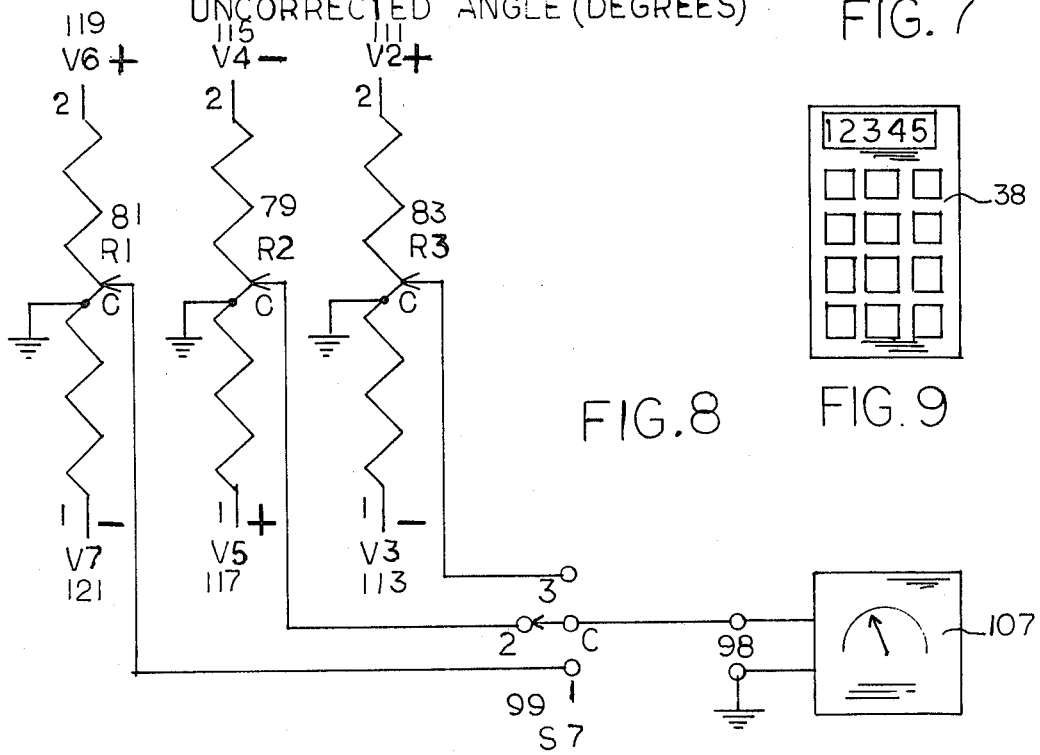
FIG. 8
FIG. 9

PERSPECTIVE DRAWING MACHINE

BACKGROUND OF THE INVENTION

1. Field of the Invention

This invention relates to the field of drafting or more particularly to the field of perspective drawing. Furthermore, it relates to perspective drawing machines that keep track of chosen vanishing points rather than machines that produce a perspective of an object from plane views of the object.

2. Description of the Prior Art

In the past there have been several methods to produce a perspective drawing:

One method is to measure every line to make that line point to an invisible vanishing point.

Another method uses educated guesses which takes many years of practice and only very experienced people produce perspective drawings in this manner.

There are machines that can produce a perspective drawing of an object from plane views thereof such as conventional plan, front and side elevations: one such patent is described in U.S. Pat. No. 2,714,253.

Therefore there has been a long standing need for a machine that will keep track of the chosen vanishing points and that can be alternated quickly from a left hand vanishing point to a right hand vanishing point and then to a standard drafting machine when required. There has also been a long standing need for a machine that a high school student could understood to master the technique or perspective drawing.

SUMMARY OF THE INVENTION

Accordingly, the problems and difficulties encountered with the prior systems are obviated by the present invention which provides a perspective drawing machine simple enough to be used by anyone with very little training.

U.S. patent application No. 109,343 shows 2 types of perspective drafting machines. The first is a completely mechanical machine which when set will automatically follow a chosen vanishing point within an error limit. The second is an electronic machine that can automatically remove the error and will manually or automatically set the drafting rule to the corrected angle. In this patent all new material, and some material from copending U.S. patent application No. 109,343 will be described. Some old material present in this patent which is covered in copending U.S. patent application No. 109,343 will be referenced to the copending application.

This patent represents a much simpler machine in which the operator finds the multiplier from graphs, does the multiplying on a calculator and manually sets in the corrected angle. To operate the draftsman chooses the volts per degree of the uncorrected angle of the drafting rule. Because the output potentiometer is a linear single turn potentiometer a graph of uncorrected angle VS output voltage can be drawn. Next a graph of uncorrected angle versus multiplier can be plotted using the chart shown in FIG. 15 of the copending U.S. patent application No. 109,343.

The position of the vanishing point is chosen by finding the maximum angle to be used in the drawing at a fixed distance from the eye level position. With the rule on the eye level line, the clutch in question is loosened by the spanner wrench and the potentiometer is rotated for zero volts out. Said clutch is then re-tightened with spanner wrench and thereafter will turn with rotation of follower gear. The machine is then moved to the extreme end of the range and the voltage set by varying the proper power supply to the voltage of the maximum angle chosen divided by the correction factor because the chosen angle is the corrected angle.

The clutch on the output side is operated by the clutch mechanism shown in FIGS. 2 and 7 of the copending application. This clutch is used to convert the machine from a perspective to a standard drafting machine.

A single round way is used in this patent and the rule lifting mechanism consists of rotating the entire machine until the rule lifting wheel is on the drafting table.

This distance effectively lifts the drafting rule off the drawing. This is made possible by the counter weight which balances the system on the round way.

A counter balance system could be used to prevent the machine from falling to the bottom of the round way when operated in a vertical position however this system shows a locking method to lock the case to the round way to maintain its present position.

One method of allowing the machine to be rotated to lift the drafting rule off the drawing includes a way to support block in which the round way can be rotated and a linear gear support block fastened tightly to the round way so a rotation of the round way also rotates said gear block. To cause this to happen the round way has a slot in it and a rotation lock through the ball bushing pillow block causes the round way to rotate when lifting the rule off the drawing.

V2 and V3 must either be tracking supplies or be adjusted to be equal but opposite voltages, V2 positive and V3 negative. If the eye level position is on the top or the bottom of the drawing or beyond only V4 and V6 or V5 and V7 will be needed depending on where the eye level position is. If the eye level position is somewhere between the top and the bottom of the picture then V4 and V5 must be either tracking supplies or must be adjusted to be equal and opposite. V6 and V7 must also be either tracking supplies or be adjusted to be equal and opposite polarities.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 6 is a graph of uncorrected angle versus the voltage based on ±15 volts for ±67.5 degrees.

FIG. 7 is a graph showing the uncorrected angle which will find the multiplier to be used to multiply the uncorrected voltage to find the corrected voltage which when present on the center tap of the output potentiometer will give the corrected angle.

FIG. 8 is a schematic showing the three potentiometers the output switch and a voltmeter.

FIG. 9 is a representation of an external calculator which would be used to compute the correct voltage which would lead to the corrected angle.

DESCRIPTION OF THE PREFERRED EMBODIMENT

Figure 1:
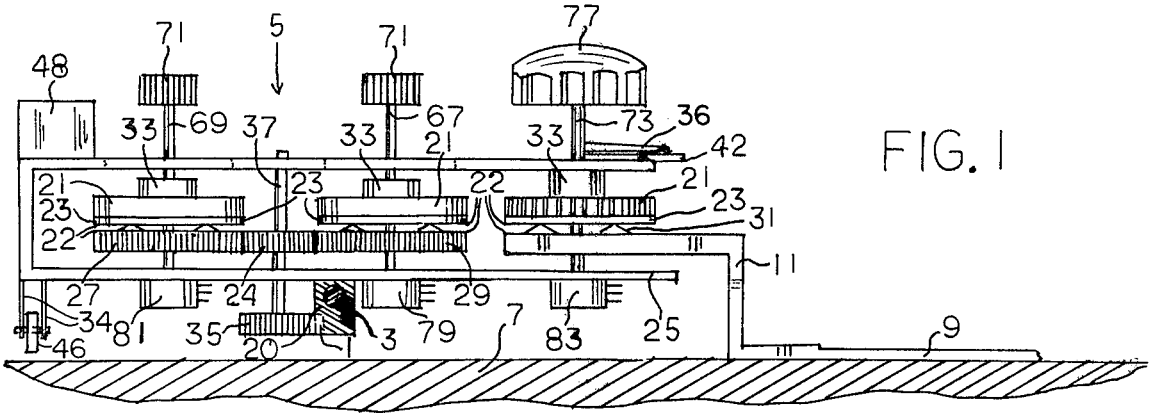
FIG. 1 is a flat line drawing showing the main parts of this drafting machine.

Referring to the drawings and particularly FIG. 1, a perspective drawing machine 5 is shown on a drafting table 7. The perspective drawing machine 5 is shown riding on a wound way 3, which is fastened tightly to a linear gear support block 20 by a lock screw 40. Riding on the linear gear is a follower gear 35 with a shaft 37 passing up through the bottom of a case 25 to an input gear 24 and on up to the top of the case 25. This shaft is locked vertically to the case by standard means. The follower gear 35 and the input gear 24 are locked solidly to the shaft 37.

Figure 10:
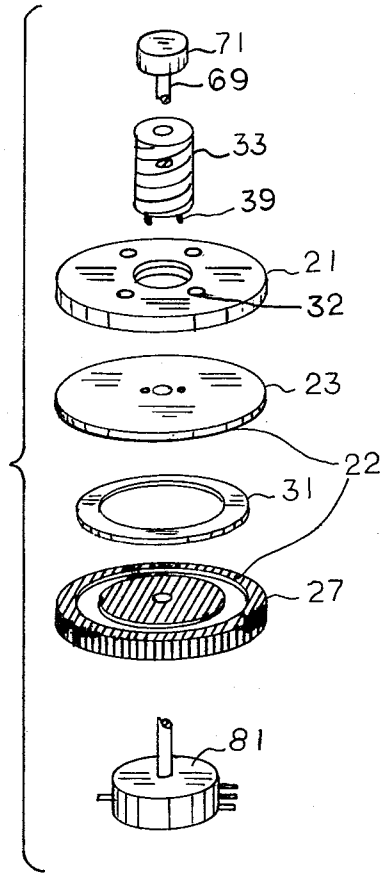
FIG. 10 is a blow up of the components on the left vanishing point shaft.

The left vanishing point potentiometer 81 is fastened to the case 25 with its shaft 69 passing up to and through a left vanishing point input gear 27, through a clutch 21 riding on a threaded hub 33 then through a hole in the top of the case 25 and on up to a knob 71. The left vanishing point input gear 27 is fastened loosely to the shaft 69 and the threaded hub 33 is fastened tightly to the shaft 69. A clutch plate 23 is fastened rotatably to the threaded hub 33 by clutch plate retainers 39, shown in FIG. 10, and is separated from the left vanishing point input gear by a wavespring washer 31 which rides in grooves in the left vanishing point input gear 27 and the clutch plate 23 whose purpose is to push these items apart when disengaging. The clutch plate 23 and the left vanishing point input gear 27 have a non slip surface 22 on their facing portions.

A right vanishing point potentiometer 79 is fastened to the case 25 with its shaft 67 passing up to and through a right vanishing point input gear 29, through a clutch 21 riding on a threaded hub 33 then through a hole in the top of the case 25 and on up to a knob 71. The right vanishing point input gear 29 is fastened loosely to the shaft 67 and the threaded hub 33 is fastened tightly to the shaft 67. A clutch plate 23 is fastened rotatably to the threaded hub 33 by clutch plate retainers 39, shown in FIG. 11, and is separated from the right vanishing point input gear 29 by a wavespring washer 31, which rides in grooves in the right vanishing point input gear 29 and the clutch plate 23, whose purpose is to push these items apart when disengageing. The clutch plate 23 and the right vanishing point input gear 29 have a non slip surface 22 on their facing portions.

An output potentiometer 83 is fastened to the case 25 with the input shaft 73 passing up through the drafting rule coupler 11 which is tightly connected to the shaft 73. Note: With the drafting rule on the zero degree mark the output potentiometer 83 is rotated with respect to the drafting rule coupler until the fixed center tap and the variable center tap are exactly zero ohms apart. The output shaft 73 then continues up through the threaded hub 33, which is loosely connected to the output shaft 73, and solidly connected to the case 25, on up through the case to the drafting rule knob 77 which is connected tightly to the input shaft 73. Riding on the threaded hub 33 is a clutch 21. A clutch plate 23 is fastened rotatably to the threaded hub 33 by clutch plate retainers 39, shown in FIG. 12 and is separated from the drafting rule coupler 11 by a wavespring washer 31, which rides in grooves in the drafting rule coupler 11 and the clutch plate 23, whose purpose is to push these items apart when disengaging.

On top of the case 25 is shown a counter weight 48 which would balance the perspective drawing machine 5 on the round way 3. The wheel holders 34 hold the rule lifting wheel 46. Fastened to the drafting rule coupler 11 is a drafting rule 9 with a quick disconnect connection.

Figure 2:
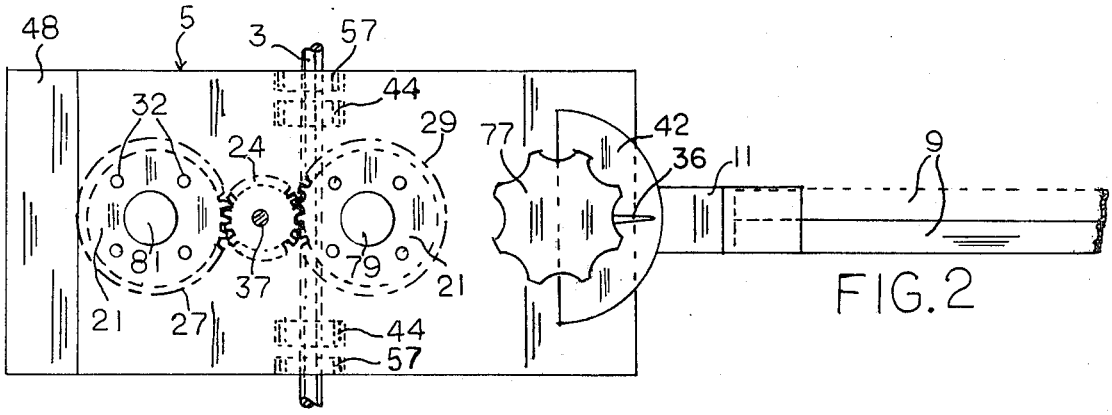
FIG. 2 is a flat drawing showing the gear arrangement and the drafting rule control knob and drafting rule.

FIG. 2 is a view looking down on the perspective drawing machine 5 showing the main parts. The left vanishing potentiometer 81 is shown in relation to the left vanishing point input gear 27 coupled to the input gear 24 which is coupled to the right vanishing point input gear 29. On top of the input gears 27 and 29 are shown the clutches 21 and the spanner wrench holes 32. The round way 3 is shown and the ball bushing pillow blocks 57 on either side of the case and a locking mechanism 44 next to each ball bushing pillow block. The right vanishing point potentiometer 79 is also shown. On the rule side the drafting rule 9 is shown. The dotted lines means it could be used on either side of the drafting rule coupler 11 to draw either on the top or bottom of the drafting rule 9. On top the drafting rule knob 77 is shown with a protractor 42 and a degree pointer 36.

Figure 3:
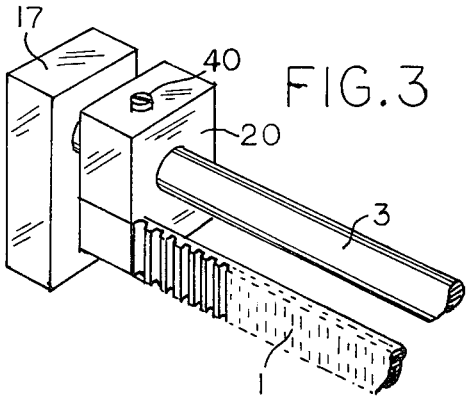
FIG. 3 shows the arrangement of the round way rotatably connected to the way support block and tightly connected to the linear gear support block.

Referring to FIG. 3 a way support block 17 is shown with a round way 3 rotatably connected to the way support block and a linear gear support block 20 connected solidly to the round way 3 by the lock screw 40. The linear gear 1 is attached to this linear gear support block 20 and to another linear gear support block 20 at the opposite end of the round way 3.

Figure 4:
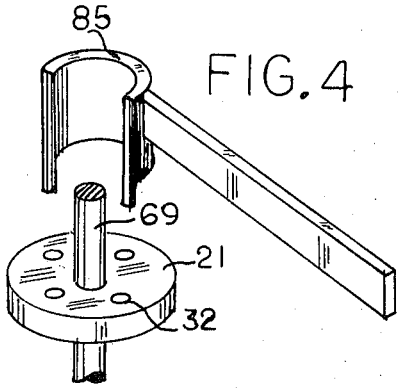
FIG. 4 shows the spanner wrench and clutch system it operates.

Referring to FIG. 4, a method of locking the clutches 21 on the left and right vanishing point gears 27 and 29 is shown. A spanner wrench 85 is shown which when dropped through the holes in the top of the case, would mate with the holes 32 as shown in the clutch 21.

Figure 5:
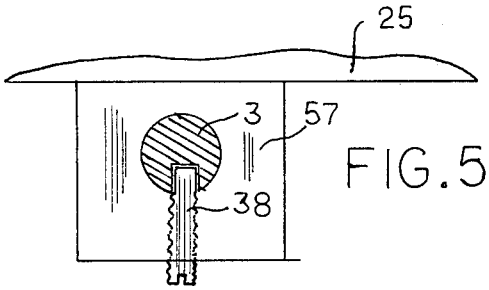
FIG. 5 shows a method of causing the round way to turn when tilting machine to take drafting rule off the drawing.

Referring to FIG. 5, to allow the entire round way 3 to rotate when lifting the drafting rule 9 off the drawing to change the position of the drafting rule 9 the round way 3 has a groove in it the length of the round way 3 and a rotation lock 38 is installed in the ball bushing pillow block 57 which allows horizontal motion but causes the round way 3 to turn circularly with the movement of the perspective drawing machine 5.

Referring to FIG. 8, an electrical representation of this simple system is shown. R2 79, and R1 81 change position when ever the perspective drawing machine 5 is moved on the round way 3. When beginning a drawing the fixed center tap and the movable center tap are set together with the drafting rule 9 on the eye level position. The clutch 21 is then tightened and from then on a movement of the perspective drafting machine 5 on the round way 3 causes a movement of the movable center tap. R2 79, and R1 81 are multi-turn potentiometers so that a step down ratio of the input gear 24 to the left and right vanishing point gears 27 and 29 so that it takes ±10 turns of the input gear to produce ±5 turns of the left and right vanishing point potentiometers 81 and 79. R3 83 is a single turn potentiometer. Note: With the drafting rule 9 on the eye level position rotate R3 83, until the fixed center tap and the variable center tap are together. Then lock R3 83 to the case 25. The center taps of these three potentiometers 79, 81 and 83 go to one pole of a three pole rotary switch S7, 99 and the center rotary pole of S7, 99 goes to an output jack 98 where an external volt meter 107 can be plugged in too read the voltages. An external calculator 38 is shown in FIG. 9 to do the needed computations.

FIG. 9 is a representative drawing of an electronic calculator that would be used to calculate the correct voltage to be read on the output potentiometer, which will point the drafting rule 9 to the correct vanishing point. Refering to FIG. 10 the left vanishing point potentiometer 81 is fastened to the case 25 with its shaft 69 passing up through the case 25 to the left vanishing point input gear 27 through a wavespring washer 31 up through a clutch plate 23, through a threaded hub 33 which has a clutch 21 riding on its threads, up through the top of the case 25 to a knob 71. The clutch plate 23 is held rotatably to the threaded hub 33 by clutch plate retainers 39. The threaded hub 33 is connected solidly to the shaft 69 with a set screw. A non slip surface 22 is on the facing portion of the clutch plate 23 and the left vanishing point input gear 27 and the wavespring washer 31 is used to push the clutch plate 23 and the left vanishing point input gear 27 apart when disengaged.

Figure 11:
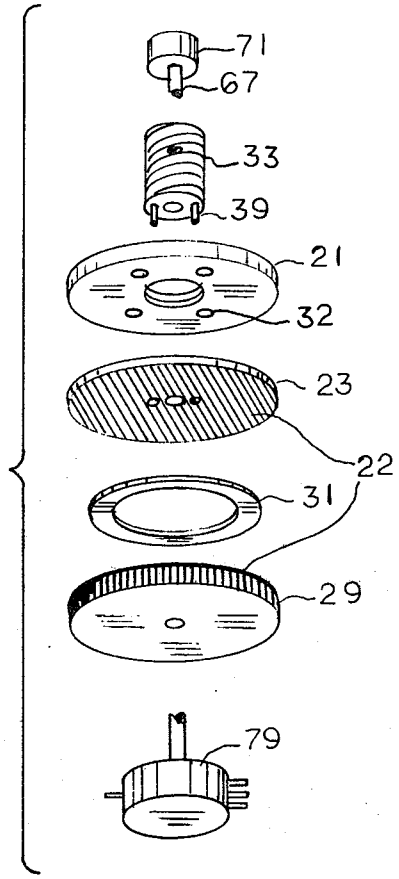
FIG. 11 is a blow up of the components on the right vanishing point shaft.

Refering to FIG. 11 the right vanishing point potentiometer 79 is fastened to the case 25 with its shaft 67 passing up through the case 25 to the right vanishing point input gear 29, through a wavespring washer 31, up through a clutch plate 23, through a threaded hub 33, which has a clutch 21 riding on its threads, up through the top of the case 25 to a knob 71. The clutch plate 23 is held rotatably to the threaded hub 33 by clutch plate retainers 39. The threaded hub 33 is connected solidly to the shaft 67 with a set screw. A non slip surface 22 is on the facing portions of the clutch plate 23 and the right vanishing point input gear 29 and the wavespring washer 31 is used to push the clutch plate 23 and the right vanishing point input gear 29 apart when disengaged.

Figure 12:
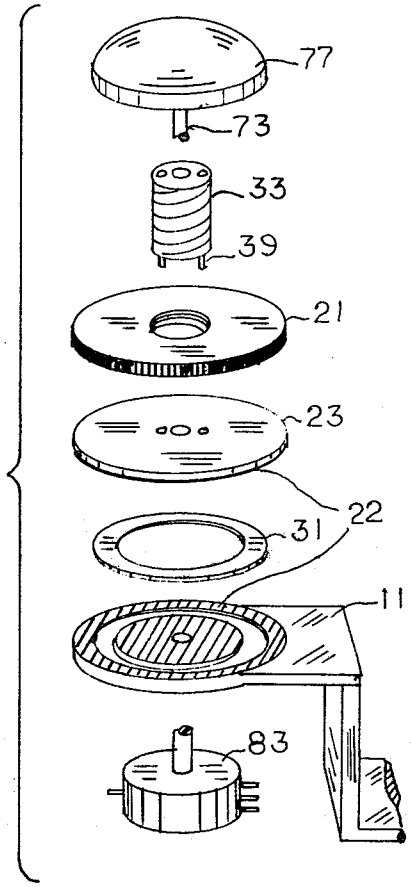
FIG. 12 is a blowup of the components on the output shaft.

Refering to FIG. 12 the output potentiometer 83 is fastened to the case 5 with its shaft 73 passing up through the case 25 to the drafting rule coupler 11 which is fastened tightly to the case, 25, through the wavespring washer 31, up through a clutch plate 23, through a threaded hub 33 which has a clutch 21 riding on its threads, up through the top of the case 25 to a control knob, 77. The clutch plate 23 is held rotatably to the threaded hub 33 by clutch plate retainers 39. The threaded hub 33 is fastened tightly to the case 25 by two screws screwed into threaded holes in the top of the threaded hub 33. A nonslip surface 22 is on the facing portions of the clutch plate 23 and the drafting rule coupler 11 and the wavespring washer 31 is used to push the clutch plate 23 and the drafting rule coupler 11 apart when disengaged.

What is claimed is:

1. An electronic perspective drawing machine comprising:

a case having at least a top and a bottom;

means mounting said case above a drawing surface for linear movement between one chosen position to another chosen position;

drafting rule means pivotally mounted to said case;

a linear gear secured to a drawing surface and extending the length or width of the drawing surface;

a rotatable input shaft extending through bearings in the top and bottom of said case;

a follower gear connected solidly to said input shaft, said follower gear riding on and engaging said linear gear;

a drive gear also mounted on said input shaft between the top and bottom of said case;

right and left vanishing point input gears mounted in said case meshing with said drive gear;

means connected to both said right and left input gears to produce a voltage potential proportional to the change of position of said case;

means connected to said drafting rule means to produce a voltage potential proportional to a pivotal movement of said drafting rule from zero reference potential at the eye level position;

said case including means for lifting the drafting rule off the drawing surface;

means to lock said case against lateral movement; and means to selectively measure said voltage potentials.

2. The invention as described in claim 1 wherein said means mounting said case above a drawing surface for linear movement between one chosen position to another chosen position comprising a round way running the length or width of said drawing surface having a groove running the entire length thereof;

a way support block at each end of said round way and rotatably connected to said round way:

one or more ball bushing pillow blocks on said round way having a rotation lock inserted into said groove, to cause a rotational movement of said case to rotate said round way, to which said case is connected;

a linear gear support block mounted tightly to said round way next to the way support block to cause said linear gear to rotate with said rotational movement of said case; and said linear gear being mounted to said support block in parallel relation to said round way.

3. The invention as described in claim 1 wherein said means connected to said drafting rule means to produce a voltage potential proportional to a pivotal movement of said drafting rule from zero reference potential at the eye level position comprising a single turn output potentiometer connected to the bottom of said case, said potentiometer having a fixed center tap and a variable tap;

a minus voltage power source connected to one side of said potentiometer;

a plus voltage power source connected to the other side of said potentiometer;

said potentiometer shaft passing upwards through said case to and through a drafting rule coupler which is tied tightly to said shaft, then on upwards to and through a bearing in top of said case;

the shaft of said output potentiometer is connected solidly to an output shaft;

means to fix said drafting rule coupler tightly to said case;

said plus and minus power sources fixed and equal but opposite polarities and adjusted to give so many volts per degree of rotation; and means to move said drafting rule in said pivotal movement until the corrected voltage appears at said variable tap of said single turn output potentiometer.

4. The invention as described in claim 3 wherein said means to move said drafting rule in said pivoted movement until the corrected voltage appears at the variable tap of said single turn output potentiometer comprising:

a manual control knob on the top of said output shaft so that the operator can manually turn said drafting rule.

5. The invention as defined in claim 3 wherein said means to fix said drafting rule coupler tightly to said case comprising:

one threaded hub connected loosely on said output shaft and connected solidly to said top of said case;

a ratchet clutch riding on said threaded hub, said ratchet clutch is threaded to ride on said threaded hub threads and has extrusions on the outside resembling geer teeth;

a clutch plate connected to said threaded hub by pins arranged to retain said clutch plate loosely vertically to said threaded hub but to prevent circular movement with respect to said threaded hub;

a non slip surface on one side of said clutch plate and the facing portion of said drafting rule coupler;

a wave spring washer between said clutch plate and facing portion of said drafting rule coupler; and means to turn said ratchet clutch on said threaded hub to bring said non slip surfaces tightly together.

6. The invention as described in claim 1 wherein said means connected to both said right and left input gears to produce a voltage potential proportional to the change of position of said case comprising:

a right vanishing point ten turn potentiometer connected to the bottom of said case;

a left vanishing point ten turn potentiometer connected to the bottom of said case;

said potentiometer having a fixed tap at the center thereon and a variable tap;

a left vanishing point shaft connected solidly to said left vanishing point potentiometer shaft, extending upwards through said left vanishing point input gear, which is loosely connected to said shaft, continuing upwards through a hole in the top of said case;

means to connect said left vanishing point input gear to said shaft;

a right vanishing point shaft connected solidly to said right vanishing point potentiometer shaft, extending upwards through said right vanishing point input gear, which is loosely connected to said shaft, continuing upwards through a hole in the top of said case;

means to connect said right vanishing point input gear to said shaft;

means to control the position of said vanishing points; and means to compute a correction voltage potential equal to said voltage potential proportional to the change of position of said case multiplied by a multiplier for both said right vanishing point and said left vanishing point.

7. The invention as described in claim 6 wherein said means to connect said left vanishing point input gear to said shaft and said right vanishing point input gear to said shaft comprising:

a threaded hub connected solidly to said shafts;

a clutch riding on said threaded hub, said clutch is threaded to ride on said threaded hubs threads;

a clutch plate connected to said threaded hub by pins arranged to retain said clutch plate loosely vertically to said threaded hub but to prevent circular movement with respect to said threaded hub;

a non slip surface on one side of said clutch plate and the facing portion of said gear;

a wave spring washer between said clutch plate and the facing portion of said gear to separate said parts when required;

a special spanner wrench to turn said clutch on said threaded hub to bring said non slip surfaces tightly together; and holes in said gears to accomodate said spanner wrench.

8. The invention as described in claim 6 wherein said means to compute a correction voltage potential equal to said voltage potential proportional to the change of position of said case multiplied by a multiplier for both said right vanishing point and said left vanishing point comprising:

a single pole three position switch connected as follows;

the number 1 pole connected to said variable tap of said left vanishing point potentiometer, the number two pole connected to said variable tap of said right vanishing point potentiometer and the number three pole connected to said variable tap of said output potentiometer, the center pole being connected to one side of an output jack, the otherside of said output jack connected to ground;

an external voltmeter connected to said output jack to measure the uncorrected voltage of said left vanishing point or said right vanishing point potentiometers; and said voltage to be multiplied by the proper multiplier by an external calculator or computer.

9. The invention as described in claim 6 wherein said means to control the position of said vanishing points comprising:

a positive variable power supply connected to one side of said right vanishing point potentiometer;

a negative variable power supply connected to the other side of said right vanishing point potentiometer;

a negative variable power supply connected to one side of said left vanishing point potentiometer;

a positive variable power supply connected to the other side of said left vanishing point potentiometer; and power supplies to be equal and opposite potentials said positive and negative supplies of each potentiometer being equal and opposite potentials.

10. The invention as described in claim 1 wherein said case including means for lifting the drafting rule off the drawing surface comprising:

a wheel on the back and bottom of said case thereof at the side opposite to said drafting rule means for engagement with said drawing surface and a counter weight on said case.

* * * * *